United States Patent [19]

Burns

[11] 4,124,208

[45] Nov. 7, 1978

[54] HOCKEY STICK CONSTRUCTION

[75] Inventor: Charles E. Burns, Winchester, Tenn.

[73] Assignee: Numerical Control, Inc., St. Louis, Mo.

[21] Appl. No.: 795,094

[22] Filed: May 9, 1977

[51] Int. Cl.[2] ..... A63B 59/14

[52] U.S. Cl. ..... 273/67 A

[58] Field of Search ..... 273/67 R, 67 A, 73 R, 273/73 C, DIG. 7

[56] References Cited

U.S. PATENT DOCUMENTS

| | | | |
|---|---|---|---|
| 3,015,327 | 1/1962 | Lightcap | 273/DIG. 7 |
| 3,201,138 | 8/1965 | Brown | 273/73 F X |
| 3,276,784 | 10/1966 | Anderson | 273/73 F X |
| 3,635,483 | 1/1972 | Barriball et al. | 273/73 F X |
| 3,677,542 | 7/1972 | Michaud | 273/67 A |
| 3,879,035 | 4/1975 | Danchulis et al. | 273/73 C |
| 3,970,324 | 7/1976 | Howat | 273/DIG. 7 |
| 4,013,288 | 3/1977 | Goverde | 273/67 A |
| 4,042,238 | 8/1977 | Theriault | 273/73 C |

FOREIGN PATENT DOCUMENTS

| | | | |
|---|---|---|---|
| 485,910 | 8/1952 | Canada | 273/67 A |
| 557,838 | 5/1958 | Canada | 273/67 A |
| 591,454 | 1/1960 | Canada | 273/67 A |
| 42,515 | 4/1970 | Finland | 273/67 A |
| 1,093,528 | 12/1967 | United Kingdom | 273/67 A |

*Primary Examiner*—Richard J. Apley

*Attorney, Agent, or Firm*—Cohn, Powell & Hind

[57] ABSTRACT

A hockey stick having opposed metal outer skins of continuous one piece including integral handle and blade portions with a metal honeycomb sandwiched therebetween. An adhesive secures the metal honeycomb to the inner surfaces of the metal outer skins, and a filler encloses the side edges of the stick between the metal outer skins. An expandable foam adhesive is disposed in the metal honeycomb portion between the metal outer skins along the blade portion, and is disposed in the honeycomb portion between the metal outer skins along the handle portion adjacent the blade portion. The edge filler is a plastic extending between and adhering to the inner surfaces of the metal outer skins and adhering to and filling the sides of the metal honeycomb.

3 Claims, 5 Drawing Figures

HOCKEY STICK CONSTRUCTION

BACKGROUND OF THE INVENTION

This invention relates generally to improvements in a hockey stick, and more particularly to an improved metal hockey stick construction that is extremely durable and light weight.

The conventional wood hockey stick has an obvious disadvantage in that the wood has a tendency to crack under the impact loads imposed upon the wood during usage of the hockey stick, and therefore a wood hockey stick has a short life span.

There have been attempts to develop other sport implements such as baseball bats and tennis rackets of a combination of wood and metal or of metal alone. However, these attempts have not been successful because the use of metal in the particular constructions increased the weight and made the cost prohibitive.

SUMMARY OF THE INVENTION

The present hockey stick is of a metal construction and provides an extremely long life span. In the particular hockey stick construction, the metal does not materially increase the weight beyond that of wood, and provides a stick that is extremely durable and able to withstand severe impact loads during usage, and results in a stick that is relatively inexpensive.

The hockey stick is constructed of opposed, front and back metal outer skins of continuous one piece including integral handle and blade portions, with a metal honeycomb sandwiched between the metal and outer skins along the handle and blade portions. An adhesive secures the metal honeycomb to the inner surfaces of the metal outer skins, and a filler encloses the side edges of the stick between the metal outer skins.

The metal honeycomb includes a first honeycomb portion between the outer metal skins along the handle portion and extending to the blade portion, and a second honeycomb portion between the outer metal skins along the blade portion and extending to the handle portion, the first and second honeycomb portions meeting at a juncture.

An expandable foam adhesive is disposed in the second honeycomb portion between the metal outer skins along the blade portion, and is disposed in the first honeycomb portion between the metal outer skins along the handle portion adjacent the blade portion. More particularly, the expandable foam adhesive is located at the juncture of the first and second honeycomb portions.

The adhesive securing the metal honeycomb to the inner surfaces of the metal outer skins is an epoxy sheet material laid between the honeycomb and the skins.

The edge filler is a plastic extending between and adhering to the inner surfaces of the metal outer skins and adhering to and filling the sides of the metal honeycomb.

DESCRIPTION OF THE PREFERRED EMBODIMENT

Figures 1, 2, 3, 4, 5:
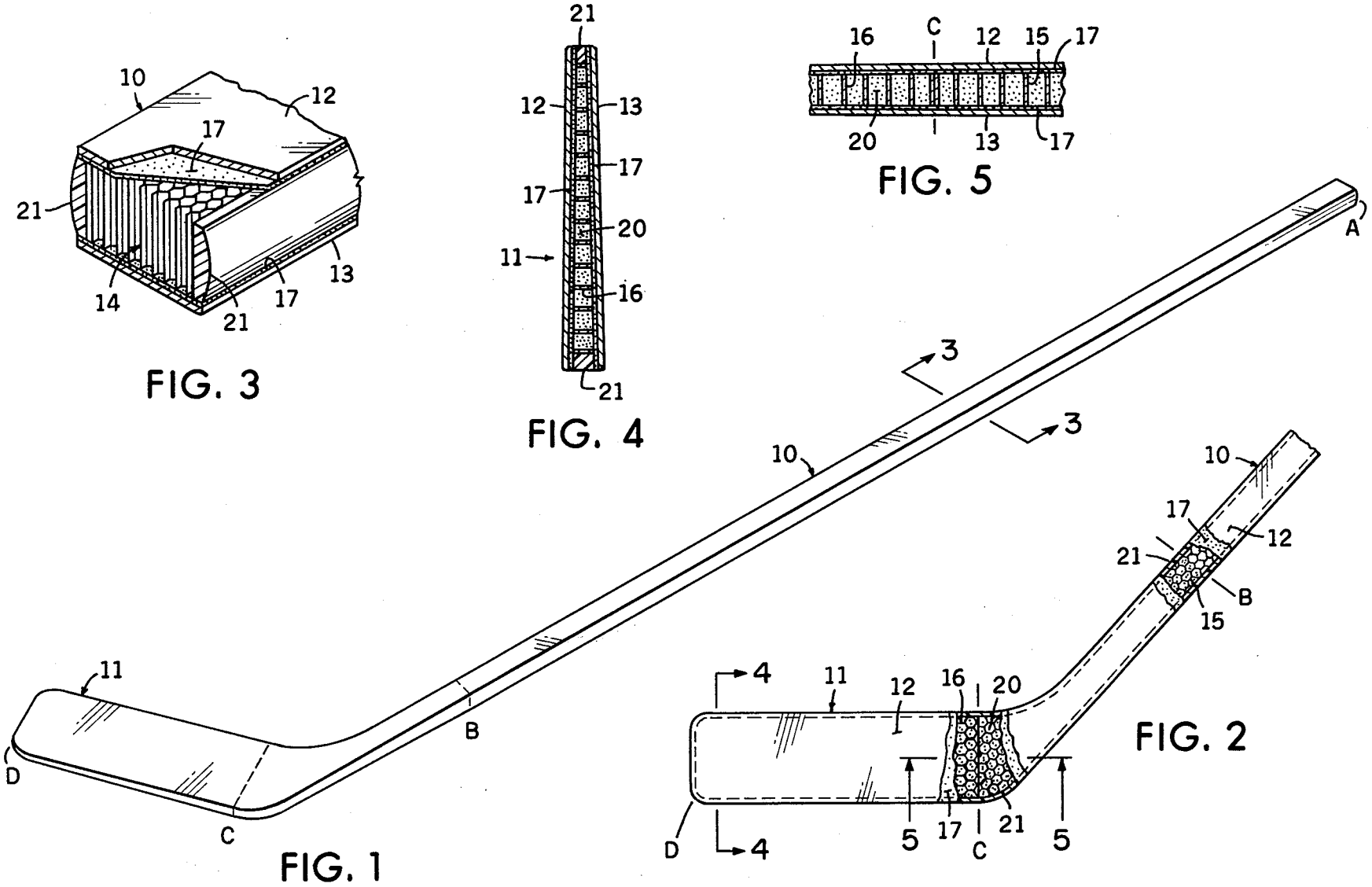
FIG. 1 is a perspective view of the hockey stick.
FIG. 2 is an enlarged, fragmentary front view of the handle and blade portions, partially cut away to show the interior.
FIG. 3 is an enlarged perspective, cross-sectional view of the handle portion taken on line 3—3 of FIG. 1.
FIG. 4 is an enlarged cross-sectional view of the blade portion as taken on line 4—4 of FIG. 2.
FIG. 5 is an enlarged, fragmentary cross-sectional view taken on line 5—5 of FIG. 2.

Referring now by characters of reference to the drawing, and first to FIG. 1, it will be understood that the hockey stick has an elongate handle portion referred to by 10 and a blade portion indicated by 11. Opposed front and back metal outer skins 12 and 13, made of aluminum, are of continuous one piece including integral handle and blade portions 10–11. A metal honeycomb referred to by 14, made of aluminum, is sandwiched between the metal outer skins 12 and 13 along the handle and blade portions 10 and 11 with the longitudinal axes of the honeycomb 14 extending in a direction transversely between the metal outer skins 12–13. The metal honeycomb 14 includes a first honeycomb portion 15 along the handle portion 10 and extending to the blade portion 11, and includes a second honeycomb portion 16 along the blade portion 11 and extending to the handle portion 10. The first and second honeycomb portions 15 and 16 abut at a juncture C.

The honeycomb portion 15 of the handle portion 10 begins to taper in thickness at the reference line B to the juncture indicated by reference line C, at which point the first honeycomb portion 15 has substantially the same thickness as the relatively thin honeycomb portion 16 of the blade portion 11.

The blade portion 11 tapers upwardly as is best shown in FIG. 4 to provide a thicker base and a thinner top.

An epoxy adhesive 17 secures the metal honeycomb 14 to the inner surfaces of the metal outer skins 12 and 13. The epoxy adhesive 17 is of a sheet material laid between the metal honeycomb 14 and the metal outer skins 12–13 and which when subjected to heat during assembly, secures the honeycomb and outer skins together.

An expandable foam adhesive 20 is located in the second honeycomb portion 16 along the blade portion 11, and is located in the first honeycomb portion 15 of the handle portion 10 across the abutment of the first and second honeycomb portions 15–16. This expandable foam adhesive 20 fills the metal honeycomb 14 the full length of the blade portion 11, across the abutment juncture C of the adjacent honeycomb portions 15–16, and fills the honeycomb 14 of the handle portion 10 for the length that the honeycomb portion 15 is tapered in the handle portion 10. Referring to FIGS. 1 and 2, the expandable foam adhesive 20 fills the honeycomb 14 between the reference lines D and B, and is indicated by dotted shading.

A urethane plastic filler 21 encloses the side edges of the stick. The filler 21 extends between and adheres to the inner surfaces of the metal outer skins 12 and 13 and adheres to and fills the sides of the metal honeycomb 14.

I claim as my invention:

1. A hockey stick, comprising:

(a) front and back metal outer skins of continuous one piece including an elongate handle portion and an integral blade portion, (b) metal honeycomb sandwiched between the metal outer skins along the handle and blade portions, the metal honeycomb including:

(1) a first honeycomb portion between the outer metal skins along the handle portion, the first honeycomb portion tapering in thickness at the neck of the handle portion and extending to the blade portion, and (2) a second honeycomb portion, thinner than the first honeycomb portion, between the outer metal skins along the blade portion and extending to the handle portion, the tapered first honeycomb portion and the thin second honeycomb portion having substantially the same thin thickness at a juncture for flexibility of the blade portion and neck of the handle portion.

2. A hockey stick as defined in claim 1, in which:

(e) an expandable foam adhesive is disposed in the thin second honeycomb portion between the metal outer skins along the blade portion, and is disposed in the tapered first honeycomb portion between the metal outer skins along the neck of the handle portion adjacent the blade portion, and (f) the edge filler is a urethane plastic extending between and adhering to the inner surfaces of the metal outer skins and adhering to the metal honeycomb.

3. A hockey stick, comprising:

(a) front and back metal outer skins of continuous one piece including an elongate handle portion and an integral blade portion, (b) a metal honeycomb sandwiched between the metal outer skins along the handle and blade portions with the longitudinal axis of the honeycomb extending in a direction transversely between the metal outer skins, the metal honeycomb including:

(1) a first honeycomb portion along the handle portion, the first honeycomb portion tapering in thickness at the neck of the handle portion, (2) a second honeycomb portion, thinner than the first honeycomb portion, along the blade portion and extending to the handle portion, the tapered first honeycomb portion and the thin second honeycomb portion having substantially the same thin thickness at an abutting juncture for flexibility of the blade portion and neck of the handle portion, (c) an adhesive of epoxy sheet material securing the metal honeycomb to the inner surfaces of the metal outer skins, (d) an expandable foam adhesive in the thin second honeycomb portion along the blade portion and in the tapered first honeycomb portion at the neck of the handle portion across the abutting juncture of the first and second honeycomb portions, and (e) a urethane plastic filler enclosing the side edges of the stick, the filler extending between and adhering to the inner surfaces of the metal outer skins and adhering to and filling the sides of the metal honeycomb.

* * * * *